United States Patent [19]

Zorini

[11] Patent Number: 4,838,047

[45] Date of Patent: Jun. 13, 1989

[54] OPERATING DEVICE FOR THREAD GUIDE RAILS IN CROCHET GALLOON LOOMS

[76] Inventor: Luigi O. Zorini, Viale Industria 12, 27024 Cilavegna Pavia, Italy, 27024

[21] Appl. No.: 124,066

[22] Filed: Nov. 23, 1987

[30] Foreign Application Priority Data

Jul. 31, 1987 [IT] Italy ..... 21545 A/87

[51] Int. Cl.[4] ..... D04B 23/00

[52] U.S. Cl. ..... 66/207

[58] Field of Search ..... 66/203, 204, 207

[56] References Cited

U.S. PATENT DOCUMENTS 4,615,189 10/1986 Durville ..... 66/207

*Primary Examiner*—Ronald Feldbaum

*Attorney, Agent, or Firm*—Laff, Whitesel, Conte & Saret

[57] ABSTRACT

A device comprising at least an eccentric 7 connected via a connecting rod 6 to a respective lever 2 fulcrumed on a fixed structure 3 and connected to a thread guide rail 4 to impart it an alternate longitudinal motion. The eccentric is mounted on a shaft 8 on which an idle wheel 12 connected to a drive wheel 10 through a toothed belt 11 is keyed. The drive wheel performs alternate rotational motions by means of a kinematic connecting rod-crank mechanism 14. The gear ratio between the drive wheel and the idle wheel is such as to impart the eccentric an alternate rotatory motion according to an arc A slightly bigger than 180°. The movement of the eccentric causes the thread guide rail to be substantially subjected to prolong its pause times during the movement reversals.

5 Claims, 3 Drawing Sheets

OPERATING DEVICE FOR THREAD GUIDE RAILS IN CROCHET GALLOON LOOMS

BACKGROUND OF THE INVENTION

1. Field of the Invention

The present invention pertains to an operating device for thread guide rails in crochet galloon looms, of the type comprising at least a drive lever having one end pivoted on a fixed structure and a second end connected to a thread guide rail, at least an eccentric connected to the drive lever through a connecting rod and actuating means acting on the eccentric in order to impart the thread guide rail an alternate longitudinal movement.

The device is particularly adapted to be used in place of conventional weft-making devices in crochet galloon looms and the like.

2. Prior Art

It is known that in crochet galloon looms designed to produce bands, laces and the like the thread guide rail is generally operated so that it carries out an oscillatory motion in order to cause each threading tube mounted thereon to perform a substantially semielliptical trajectory on either side of a plurality of needles disposed in a mutual side by side relationship and lying in a horizontal plane. To this end the thread guide rail is submitted to the action of a lifter device imparting it an oscillatory motion in a vertical direction in combination with the action of a weft-making device imparting said thread guide rail a horizontal oscillatory motion in a longitudinal direction.

Both the lifter device and the weft-making device cause the operation of the thread guide rail through eccentrics provided with a continuous rotatory motion and connected to the thread guide rail by means of suitable linkages. The weft-making device is usually provided with appropriate means for suitably regulating the horizontal stroke of the thread guide rail in order to determine, depending upon the width of the lace band to be manufactured, the number of needles included within the trajectory traced by each thread guide rail.

The weft-making devices currently used are adapted to allow the horizontal translations of the thread guide rail to start, at the beginning of each forward and backward stroke thereof, at the same instant in which the lifter device begins raising the thread guide rail itself.

As a result, the threading tubes are subjected to carry out horizontal translations when their lower ends are still disposed below the lying plane of the needles and are about to be raised with respect to the needles under the action of the lifter device.

Under this situation, in order to avoid any interference between threading tubes and needles, it is necessary to make the thread guide rail strokes longer than the width of the band or lace being worked.

By this contrivance the lifter device can sufficiently raise the threading tubes before the latter, during their horizontal translation, may hit on the needles.

The increase of the horizontal strokes of the thread guide rail, and as a result of the threading tubes, involves the necessity to remove the needles located adjacent the opposed sides of the produced bands from the loom, that is to remove the needles in the regions where the movement reversal of the threading tubes occurs. Obviously, due to this situation, one portion of the whole loom length cannot be exploited for the purpose of producing manufactured products, since this portion must be left clear of needles in order to enable the movements of the thread guide rails.

Moreover in this case there is also another drawback in that it is necessary to thoroughly change the needle distribution along the loom each time the type and/or sizes of the bands or laces being worked have to be modified. Said operations, which are carried out manually, remarkably increase the working idle time necessary to set up the machine.

A further drawback of the known art is due to the fact that along the loom it is necessary to arrange members adapted to recover the excess weft yarns drawn out by the threading tubes during the idle strokes.

SUMMARY OF THE INVENTION

The object of the present invention is to eliminate the above mentioned drawbacks by providing a device adapted to impart the thread guide rail a horizontal reciprocating motion acting in such a manner as to prolong the pause times of the latter during the movement reversals, in order to allow the lifter device to raise the threading tubes a sufficient degree with respect to the needles before a new horizontal translation of the threading tubes takes place.

The foregoing and still further objects that will become more apparent in the following description are substantially achieved by an operating device for thread guide rails in crochet galloon looms wherein said eccentric is operated, upon command of the actuating means, so that it carries out an alternate rotatory motion according to an arc slightly bigger than 180° in order to prolong the pause time of the thread guide rail at the dead centers of said alternate motion.

BRIEF DESCRIPTION OF THE DRAWINGS

Further features and advantages will become more apparent from the detailed description of a preferred embodiment of a device to operate the thread guide rails in crochet galloon looms according to the present invention, given hereinafter by way of non-limiting example with reference to the accompanying drawings in which.

DESCRIPTION OF THE PREFERRED EMBODIMENT

Figure 1:
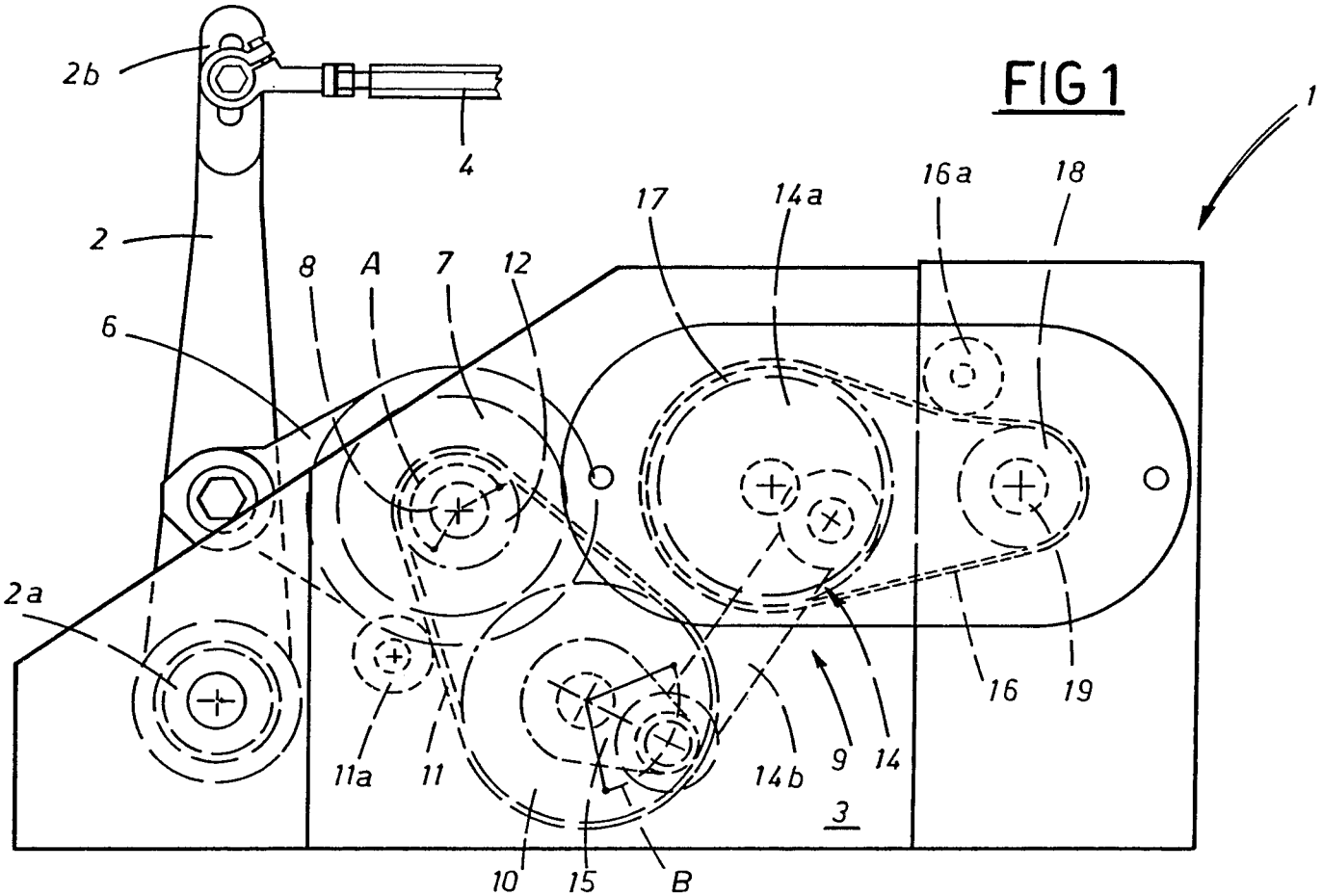
FIG. 1 is a diagrammatic side view of the device according to the invention.

Referring to the drawings and particularly to FIG. 1, a device designed to operate the thread guide rails in crochet galloon looms according to the present invention has been globally identified by reference numeral 1.

Figures 2, 2A:
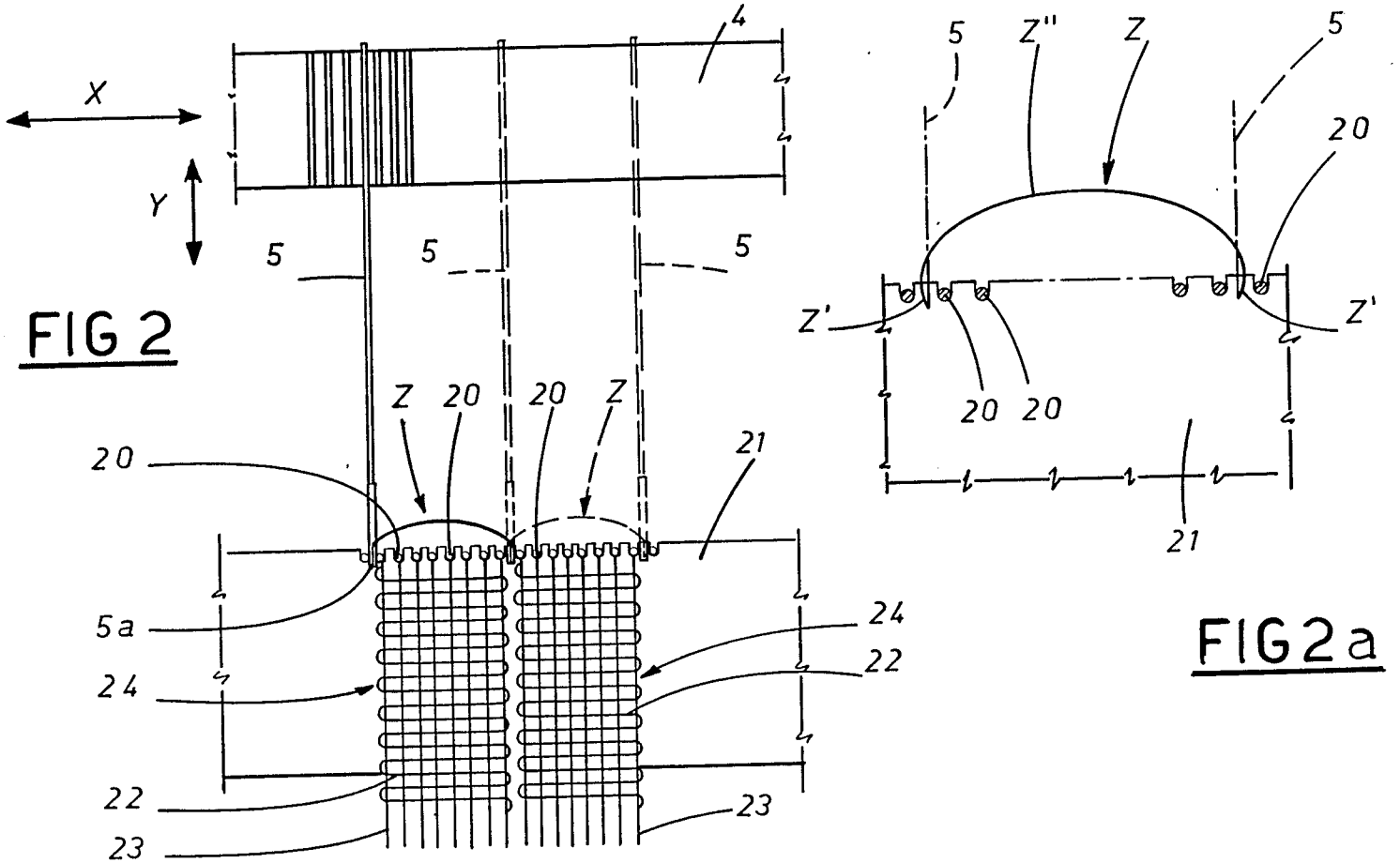
FIG. 2 is a diagrammatic fragmentary view showing a thread guide rail operated by the device in question and supporting threading tubes cooperating with the needles for the formation of the manufactured products.
FIG. 2*a* is a diagrammatic view, to an enlarged scale, of a detail of FIG. 2 showing the trajectories taken by the lower ends of the threading tubes with respect to the needles during the working.

The device 1 comprises at least a drive lever 2 one end 2*a* of which is rotatably pivoted on a fixed structure 3 and the second end 2*b* of which is operatively engaged, with a thread guide rail 4 along which a plurality of threading tubes 5 is conventionally distributed (FIG. 2).

Fulcrumed on the drive lever 2 is a connecting rod 6 operated by an eccentric 7 keyed on a shaft 8 rotatably engaged to the fixed structure 3.

Conventionally several eccentrics 7 are provided to be keyed on the shaft 8, each of them being connected, via a respective connecting rod 6, to a drive lever 2 in order to operate several thread guide rails 4 or, where necessary other members provided in the loom.

In an original manner, the shaft 8 is driven by actuating means acting in such a way that they impart the eccentric 7 an alternate rotatory motion according to an arc, marked by reference A, slightly bigger than 180°, to the ends to be described later.

In the embodiment shown the actuating means 9 comprises a drive wheel 10 rotatably connected to structure 3 and also connected to the shaft 8 via a first toothed belt 11 trained around the drive wheel and an idle wheel 12 keyed on the shaft 8. The tensioning of the first belt 11 is controlled by a first jockey pulley 11*a*.

The drive wheel 10 is operated by means of a kinematic connecting rod-crank mechanism 14 so that it carries out an alternate rotatory motion. The kinematic connecting rod-crank mechanism comprises a crank 14*a* rotatably supported with respect to the fixed structure 3 and to which a connecting rod 14*b* acting on a lever 15 integral to the drive wheel 10 is connected.

The kinematic connecting rod-crank mechanism 14 is operated through a second toothed belt 16 trained around a second idle wheel 17 coaxially and rigidly connected to the crank 14*a* and around a drive wheel 18 keyed on a drive shaft 19 which is conventionally operated so that it carries out a rotatory motion in synchronism with the movements of the various members included in the loom. The tensioning of the second toothed belt 16 is controlled by a second jockey pulley 16*a*.

The operation of the apparatus in question is as follows.

The drive wheel 18, upon command of the drive shaft 19, causes the operation of the kinematic connecting rod-crank mechanism 14 through the second toothed belt 16. The kinematic connecting rod-crank mechanism 14 imparts the lever 15, and consequently the drive wheel 10, an oscillatory rotational movement according to an arc of a predetermined opening marked by reference B.

The rotational oscillations of the drive wheel 10 are then transmitted, via the first toothed belt 11, to the idle wheel 12 and consequently to the eccentric 7. The gear ratio between the drive wheel 10 and idle wheel 12 is calculated on the basis of the opening of arc B, in such a manner that the oscillation arc A of the eccentric 7 is slightly bigger than 180°, preferably between 190° and 210°. In the embodiment shown, the rotational oscillation arc B of the drive wheel 10 has a value of 100°. The gear ratio between the drive wheel 10 and idle wheel 12 is equal to 1:2, so that the rotational oscillation arc A of the eccentric 7 corresponds to 200°.

The rotational oscillations performed by eccentric 7 are transmitted, through the connecting rod 6 and drive lever 2, to the thread guide rail 4 which is therefore imparted a horizontal oscillatory motion shown by arrow X in FIG. 2. Said motion takes place in the longitudinal extension direction of rail 4.

The amplitude of the horizontal oscillatory motion X can be adjusted where necessary, depending upon requirements, by adjusting means associated with the eccentric 7 and not shown as conventional and known per se.

Still in a conventional and known manner, in operation the thread guide rail 4, upon command of a lifter device not shown as it is not important to the ends of the invention, is also submitted to a vertical oscillatory motion, shown by arrow Y in FIG. 2, the frequency of which is twice the frequency of the horizontal oscillatory motion X. The combination of the horizontal X and vertical Y oscillatory motions causes the lower ends 5*a* of the threading tubes 5 to be moved according to an oscillatory motion following a trajectory Z extending on either side of a plurality of needles 20 disposed in a mutual side by side relationship and supported by a needle bar 21 extending parallelly to the thread guide rail 4.

In greater detail and as clearly shown in FIG. 2*a*, the lower end 5*a* of each threading tube 5 starts its motion from a position located below the common lying plane of needles 20 and is first raised with respect to the latter while describing a substantially vertical trajectory length Z′, then it is displaced and further raised with respect to the needles while describing a semielliptical trajectory length Z″.

During the execution of trajectory Z, each threading tube 5 leaves a weft yarn 22 lying on needles 20. At the end of the translation with respect to needles 20 the end 5*a* is brought again, by means of a vertical descending motion, below the lying plane of the needles. Under this situation, the needles 20 interlace the weft yarns 22 with the warp yarns 23 to allow a fabric workpiece in the form of a band 24 to be formed.

If the rotational oscillation arc A of the eccentric 7 would be equal to 180°, the horizontal alternate motion X imparted to the thread guide rail 4 according to the invention would be substantially identical to the motion of the thread guide rails operated by known weft-making devices in which the eccentric performs a continuous rotatory motion.

Since in the present invention the rotational oscillation arc A is instead slightly bigger than 180°, the thread guide rail 4 is bound to carry out, at the dead centers of the horizontal oscillation motion X, several horizontal oscillations of very reduced amplitude, anyway smaller than the distance existing between two adjoining needles.

In greater detail, each time the thread guide rail 4 reaches one of the dead centers of the horizontal oscillatory motion X, it tends to perform a first movement reversal by effect of the rotation of the eccentric 7, a second movement reversal caused by the reversal of rotation of the eccentric, and a third movement reversal due to the rotation of the eccentric after the reversal of rotation of the latter has taken place.

Figure 3:
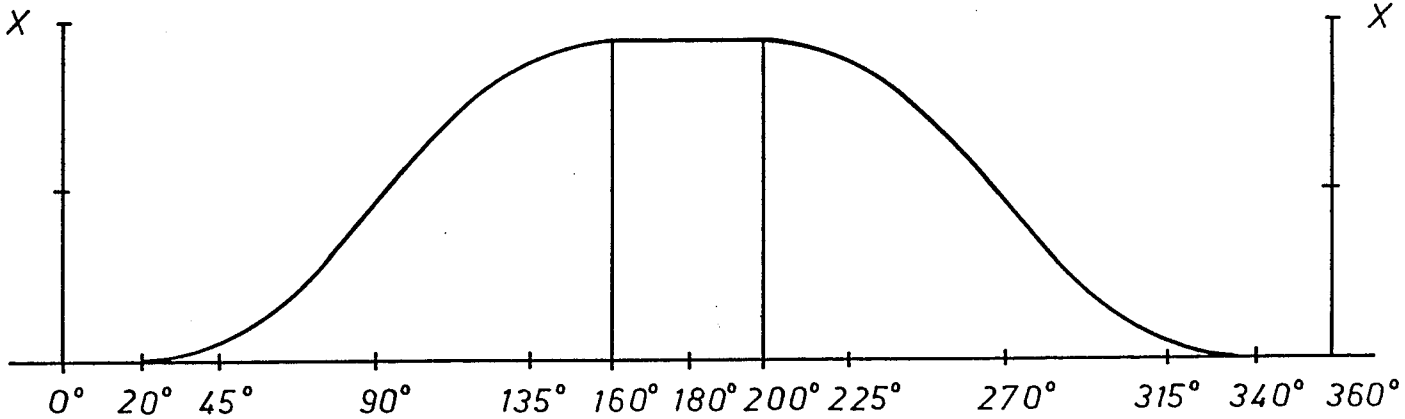
FIG. 3 is a diagram showing the horizontal translations performed by the thread guide rail during the rotation of the crank being part of the kinematic connecting rod-crank mechanism included in the device in question.

Under this situation the thread guide rail 4 is substantially subjected to prolong its pause times at the dead centers of the horizontal oscillatory motion X. This situation is clearly seen in the diagram of FIG. 3 showing the angles of rotation performed by cranks 14 on the abscissa axis and the corresponding values of the translations the thread guide rail 4 consequently undergoes on the ordinate axis.

As clearly viewed in said diagram, there are lengths along which, although the crank 14*a* carries out angular rotations of about 40°, practically the thread guide rail 4 is not subjected to any rotational movement.

Said pause times of the thread guide rail 4 cause the lower ends 5*a* of the threading tubes 5 to be raised or lowered with respect to the needles 20, upon command of the lifter device, in the absence of actual horizontal translations of the thread guide rail 4. As a result it is possible, unlike the known art, to restrain the stroke of the horizontal oscillatory motion X to a strictly necessary degree so that the correct engagement of the weft yarns 22 with the desired number of needles 20 may take place without any risk for the needles being hit in operation by the lower ends 5*a* of the threading tubes 5.

Due to the stroke restriction of the horizontal oscillatory motion X, it is no longer necessary to remove the needles from the loom, as it has happened in the known art, in order to allow the passage of the threading tubes. In fact, as diagrammatically shown in FIGS. 2 and 2*a*, the device in accordance with the invention is adapted to allow the threading tubes to be inserted in operation between two adjoining needles 20 without touching them.

The present invention attains the intended purposes.

Since it is no longer necessary to remove some needles from the loom, it is possible to exploit a greater number of needles in a single loom for the obtention of the manufactured products. In other words, the yield of the looms is increased.

In addition, being unnecessary to remove some needles, it is possible to achieve a remarkable reduction of the idle times which are necessary to set up the loom when the types and/or sizes of the workpieces have to be changed.

Furthermore and advantageously the present invention does not require the use of members for carrying out the recovery of the excess weft yarns in operation , said members being on the contrary necessary in the known art devices.

Obviously the present invention is susceptible of many modifications and variations, all falling within the scope of the inventive idea characterizing it.

What is claimed is:

1. An operating device for thread guide rails in crochet galloon looms, comprising: a drive lever having one end pivoted on a fixed structure and the other end connected to a thread guide rail; an eccentric connected to the drive lever via a connecting rod; actuating means acting upon the eccentric imparting to the thread guide rail an alternate longitudinal motion, said actuating means comprises an idle wheel keyed on a shaft supporting said eccentric, a drive wheel operatively connected to the idle wheel to impart the latter a rotatory motion and a kinematic connecting rod-crank mechanism acting on the drive wheel to operate it according to an alternate rotatory motion; wherein said eccentric is operated, upon command of said actuating means, so that it carries out an alternate rotatory motion according to an arc slightly bigger than 180° in order to prolong the pause time of the thread guide r ail at the dead centers of said alternate motion.

2. An operating device for thread guide rails in crochet galloon looms, comprising: a drive lever having one end pivoted on a fixed structure and the other end connected to a thread guide rail; an eccentric connected to the drive lever via a connecting rod; actuating means acting upon the eccentric imparting to the thread guide rail an alternate longitudinal motion; wherein said eccentric is operated, upon command of said actuating means, so that said eccentric is imparted an alternate rotatory motion according to an arc ranging between 190° and 210° in order to prolong the pause time of the thread guide rail at the dead centers of said alternate motion.

3. The device as claimed in claim 1, wherein said eccentric is imparted an alternate rotatory motion according to an arc of 200°.

4. The device as claimed in claim 1, wherein said drive wheel is connected to the idle wheel through at least a toothed belt.

5. The device as claimed in claim 1, wherein said drive wheel is connected to the idle wheel according to a gear ratio equal to 1:2.

* * * * *